US005651460A

United States Patent [19]

Foerderer

[11] Patent Number: 5,651,460

[45] Date of Patent: Jul. 29, 1997

[54] PACK FOR ADHESIVES AND/OR SEALANTS

[75] Inventor: Guido Foerderer, Wiesloch, Germany

[73] Assignee: Teroson GmbH, Heidelberg, Germany

[21] Appl. No.: 381,941

[22] PCT Filed: Aug. 4, 1993

[86] PCT No.: PCT/EP93/02067

§ 371 Date: Feb. 13, 1995

§ 102(e) Date: Feb. 13, 1995

[87] PCT Pub. No.: WO94/04439

PCT Pub. Date: Mar. 3, 1994

[30] Foreign Application Priority Data

Aug. 12, 1992 [DE] Germany ..... 42 26 644.0

[51] Int. Cl.[6] ..... B65D 85/00

[52] U.S. Cl. ..... 206/447; 206/524.1

[58] Field of Search ..... 206/447, 524.1, 206/524.5, 524.3, 813, 817

[56] References Cited

U.S. PATENT DOCUMENTS

| | | | |
|---|---|---|---|
| 2,636,658 | 4/1953 | Baumer et al. | 226/125 |
| 4,318,475 | 3/1982 | Robinson | 206/447 |
| 5,183,152 | 2/1993 | Zak et al. | 206/447 X |

FOREIGN PATENT DOCUMENTS

| | | |
|---|---|---|
| 2918707 | 11/1979 | Germany . |
| 3605422 | 3/1988 | Germany . |
| 8812012 | 1/1989 | Germany . |

OTHER PUBLICATIONS

Adhäsion 1987, No. 12, pp. 25–26.

*Primary Examiner*—Jacob K. Ackun

*Attorney, Agent, or Firm*—Ernest G. Szoke; Wayne C. Jaeschke; Real J. Grandmaison

[57] ABSTRACT

A pack for transporting flowable air and moisture sensitive adhesive and sealant materials which consists of a transport container having a closed bottom end and an open top end, a collapsible inner bag having a sealed lower end and a foldable open upper end wherein the collapsible inner bag is removably disposed within the transport container, a flexible apertured first disk interposed between the foldable open upper end of the collapsible inner bag and the adhesive and sealant materials contained in the collapsible inner bag wherein the first disk has a diameter larger than that of the container, and a disposable second disk interposed between the open top end of the transport container and the sealed lower end of the collapsible inner bag after the inner bag has been inverted and placed inside the transport container.

12 Claims, 1 Drawing Sheet

PACK FOR ADHESIVES AND/OR SEALANTS

BACKGROUND OF THE INVENTION

1. Field of the Invention

This invention relates to packs for adhesives and/or sealants according to the preamble of the claim, to their use and to a method for filling and emptying them.

For industrial consumers, adhesives and sealants are supplied in drums or similar large-volume containers which are generally made of metal. For moisture- and/or air-curing one-component adhesives, these packs must effectively prevent the penetration of air and moisture to avoid premature curing or hardening of the adhesive/sealant. This impermeability to air and moisture has to be guaranteed during filling, transport, storage and emptying of the pack.

In view of increasingly more stringent pollution control legislation, packs of the type in question also have to be completely or at least partly recyclable. This requirement is particularly difficult to meet in the case of moisture-curing and/or air-curing adhesives/sealants because, in the case of paste-like or high-viscosity materials, the penetration of traces of atmospheric moisture, particularly during or after emptying, can lead to partial or complete hardening on the inside of the drum. This often results in coatings which adhere firmly to the inside or bottom of the drum and which make the drums difficult, if not impossible, to clean. Even where the drums are used as scrap metal, problematical combustion products can be formed from the hardened adhesive/sealant residues.

2. Discussion of Related Art

DE-C-36 05 422 describes a method of filling and emptying a container for a flowable material, the material in question being introduced into a flexible inner pack impervious to the material. This inner pack is adapted to the dimensions of the outer transport container, generally a metal drum or sealed tin container. In this method, the bag-like inner pack is first filled with the flowable material in a pot-like temporary container by means of a suitable filling unit. The dimensions of the temporary container are somewhat smaller than the corresponding inner dimensions of the actual transport container. A stiff cover plate is then placed on the surface of the material and the inner pack is tightly closed at its upper end by folding the edges over one another and welding them together. The inner pack thus filled and sealed is then turned through 180° together with the temporary container and placed on the somewhat larger transport container so that the filled and sealed inner pack can be introduced into the transport container. The transport container is then closed with a lid. After transport to the point of use, the lid is taken off to remove the material, after which the material is removed by means of a suitable pump. The pump is best connected to a pressure follower plate. After an opening has been cut into the flat surface, the pressure follower plate is applied and the material to be removed is forced out upwards through compression of the inner pack. The method according to DE-C-36 05 422 is also described in detail in Adhesion 1987, No. 12, pages 25–26.

In the case of particularly sensitive materials, it is not sufficient for the inner pack to be impervious solely to the material introduced. Accordingly, DE-U-88 12 012 proposes bags of multilayer composite films for the inner pack, the composite films consisting of three layers of polymer film and one layer of metal foil to provide the adhesive/sealant with even better protection against the effect of moisture and/or air.

These known methods enable the transport containers to be more or less completely emptied so that they may be reused after removal of the empty inner pack and after reconditioning in the usual way, providing the containers are multi-trip containers. Non-reusable transport containers may be recycled as waste after removal of the empty inner pack.

In practice, however, it has been found that the prior art is in need of improvement in certain crucial aspects:

During the filling process, the pressure follower plate becomes soiled with material. During changing of the drum, this material is exposed to atmospheric moisture so that partial hardening occurs and, in subsequent filling cycles, leads to contamination of the material in the form of hard patches of skin or hardened lumps in the adhesive/sealant.

The stiff cover plate according to DE-C-36 05 422 which, in practice, is generally a plate of polypropylene or polyethylene at least 2 mm thick remains in the empty inner pack together with the remains of the adhesive/sealant; it cannot be recycled at reasonable expense and thus adds considerably to the cost of the inner pack as a whole. In addition, it complicates recycling of the inner pack because, in practice, only multilayer composite films with a metal foil have been successfully used as the inner pack with the result that an inseparable mixture of different packaging materials is present.

In practice, folding and welding the upper end of the inner pack has not been successful because unavoidable contamination of the wall material of the inner pack in the region to be welded with the material to be introduced (adhesive/sealant) or with auxiliaries, for example lubricants, does not offer any guarantee of a weld seam impermeable to air and moisture. Accordingly, the problem has hitherto been solved by tying the upper end of the inner pack together with several twisted wires.

For emptying, a hole has to be cut into the surface of the inner pack, the adhesive/sealant being forced upwards through this hole by means of a pressure follower plate which compresses the inner pack. The inner pack in which the hole is cut often continues to tear, leading to unwanted soiling of the pressure follower plate at the emptying unit.

DESCRIPTION OF THE INVENTION

The problem addressed by the present invention was further to develop known packs and the known methods for filling and emptying them in such a way that the disadvantages mentioned above could be avoided in an inexpensive manner.

The solution to this problem as provided by the invention is defined in the claims.

One example of embodiment of the invention is described in detail in the following with reference to the accompanying drawings. The drawings show a preferred version of the pack and the various stages involved in the filling and emptying of the pack. All the Figures are vertical sections through the pack.

The basically similar pumps for filling and emptying the material are shown in the same way.

Figure 1:
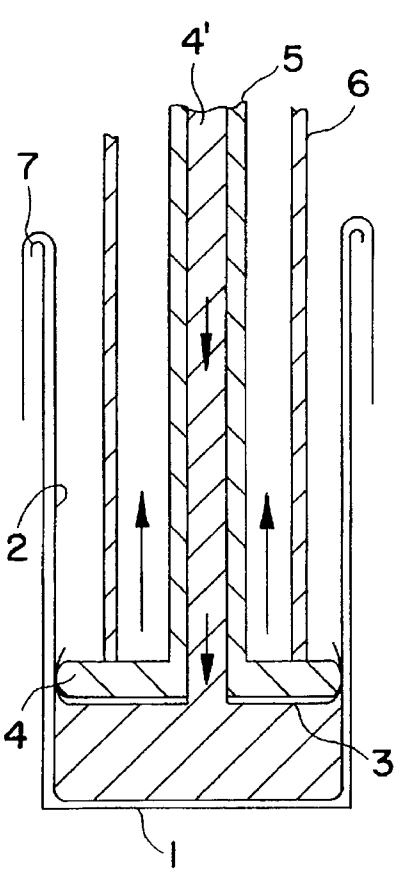
FIG. 1 shows the filling of the inner pack in the temporary container.

Referring to FIG. 1, the inner pack 2 is introduced into the temporary container 1. The disk 3 is then fixed to the pressure follower plate 4. The disk is slightly larger than the pressure follower plate so that it projects beyond the periphery of the pressure follower plate. The disk can be mechanically fixed to the pressure follower plate, for example by clips (not shown). The disk has a central hole 4 adapted to the diameter of the material feed tube 5. In a preferred embodiment, the disk is a square blank. This shape ensures that the pressure follower plate 4 is protected against soiling by the adhesive/sealant to be introduced into the inner pack. The upper end of the inner pack 2 is drawn beyond the rim 7 of the temporary container so that the inner pack bears smoothly without any creases against the inner walls of the temporary container. By means of a delivery pump (not shown), the material is then introduced in the arrowed direction through the material feed tube into the inner pack. At the same time, the pressure follower plate may either be moved upwards by the hold-down means 6 according to the filling level of the drum. Alternatively, the hold-down means 6 may rigidly fix the unit consisting of the follower plate and the material feed tube, in which case the temporary container 1 is moved downwards according to the filling level.

In preferred embodiments, the inner pack 2 and the disk 3 consist of a multilayer composite material, one layer consisting of a metal foil. The composite material consists of at least three layers, the metal foil being laminated between two polymer films. The polymer film layers preferably consist of polyolefins, for example polypropylene and/or polyethylene; the metal foil is preferably an aluminium foil. However, inner packs and disks with more than two polymer layers may also be used. Whatever the number of layers, a metal foil must be provided as an interlayer. Suitable materials for the other polymer layers are, for example, polyamide or polyester. In particularly preferred embodiments, the bag-like inner pack is made in such a way that, after introduction into the temporary container, the bottom of the pack is completely flat and crease-free.

After the pack has been completely filled, the disk 3 is released from the pressure follower plate 4, leaving the disk as a protective covering on the surface of the adhesive/sealant.

Figure 2:
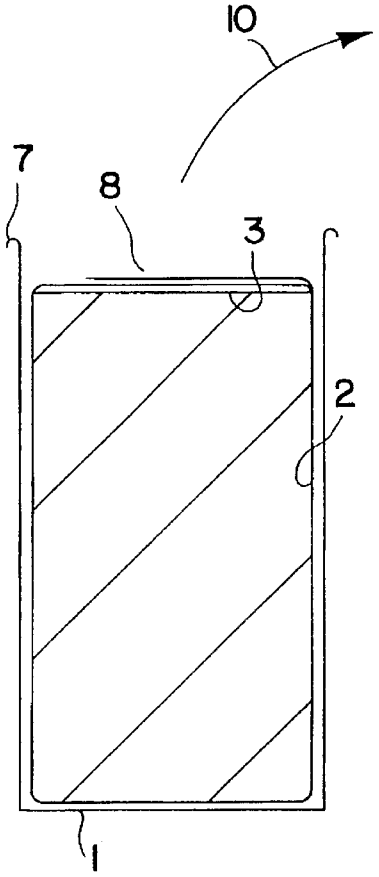
FIG. 2 shows the closed inner pack in the temporary container.

FIG. 2 shows the closed inner pack 2 in the temporary container 1. It has surprisingly been found that, where the above-mentioned composite materials are used for the inner pack 2 and the disk 3, the upper end of the inner pack need only be folded down as shown at 8 and not welded to guarantee safe protection of the adhesive/sealant against the penetration of moisture and/or air. This is a considerable simplification and saves costs.

The filled and closed inner pack is then introduced into the transport pack 9 by inversion in the direction of the arrow 10.

Figure 3:
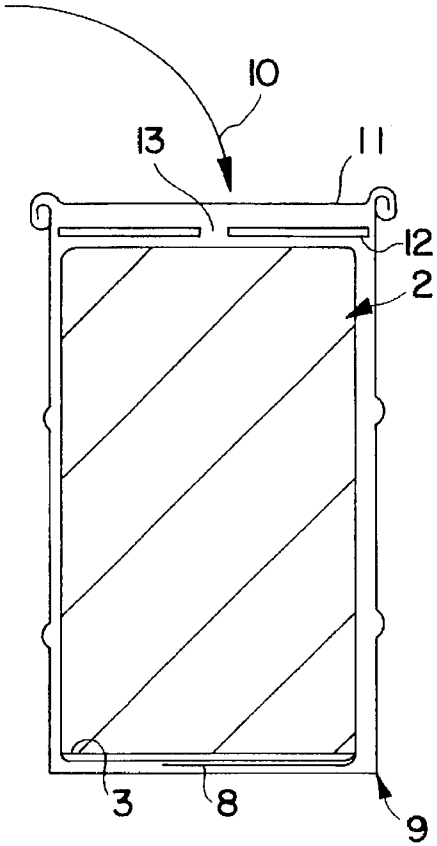
FIG. 3 shows the closed inner pack together with the transport pack.

As shown in FIG. 3, a cover disk 12 with a central hole 13 is placed on the flat surface of the inner pack before the transport pack is closed. The function of the cover disk 12 is explained in detail hereinafter. The quality of the constituent material of the cover disk is unimportant so that inexpensive materials which are easy to dispose of, for example cardboard disks, are preferably used. Finally, the transport container 9 is closed with the lid 11.

Figure 4:
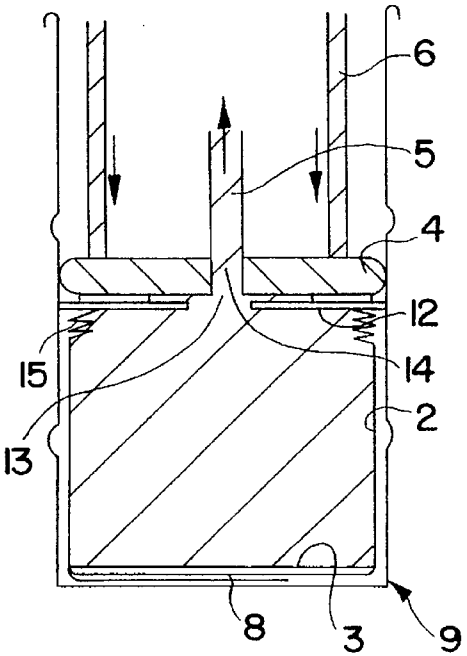
FIG. 4 shows the opened transport pack during emptying by the user.

FIG. 4 shows the emptying of the pack by the user. The lid 11 is removed and, using the cover disk 12 as a template, a hole 14 is cut into the inner pack 2 congruently with the central hole 13 of the cover disk 12. Through the hold-down means 6, the pressure follower plate 4 is pressed downwards onto the flexible inner pack 2 so that the adhesive/sealant is fed through the material feed tube 5 to a pump (not shown) and, from there, to the application system. The cover disk 12 safely prevents soiling of the pressure follower plate 4 by the adhesive/sealant, even when the wall of the inner pack 2 tears under the high feed pressure. Such soiling often occurs in the absence of a cover disk 12.

During emptying, the flexible inner pack 2 folds together concertina-fashion 15 beneath the pressure follower plate 4.

Surprisingly, the stiffness of the disk 3 of the same composite material as the inner pack 2 is sufficient to stop the disk 3 from entering the material feed tube 5 at the end of the emptying process.

Accordingly, the construction of the pack according to the invention offers a particularly economical pack form, more particularly for air- and/or moisture-sensitive, paste-like and/or highly viscous adhesives/sealants because there is no longer any need for the complicated and unreliable closure of the inner pack, for example by welding or twisting with wires, in addition to which remains of the inner pack after emptying are easier and less expensive to dispose of. The disk 3 and the inner pack 2 consist of the same material which facilitates recycling. The cover disk 12 preferably consists of an inexpensive cardboard disk which is easy to dispose of.

Many automotive adhesives/sealants, particularly those for direct glazing, have very high viscosities so that the pressure follower plate and the following feed hoses and/or tubes are heated to facilitate transport. The pack according to the invention is also suitable for this method of emptying.

Accordingly, the invention provides a pack and a method for filling and emptying containers for flowable adhesives/sealants which enables air- and/or moisture-sensitive materials in particular to be handled in a particularly inexpensive and environmentally safe manner.

I claim:

1. A pack for transporting flowable, air- and moisture-sensitive adhesive and sealant materials, comprising:

(a) a transport container having a closed bottom end and an open top end, (b) a collapsible inner bag having a sealed upper end and a folded lower end, said collapsible inner bag being removably disposed within said transport container, (c) adhesive or sealant materials disposed in said collapsible inner bag, (d) a flexible apertured first disk interposed between said folded lower end of said collapsible inner bag and said adhesive and sealant materials contained in said collapsible inner bag, said first disk having a diameter larger than that of said transport container, (e) a disposable second disk positioned over said sealed upper end of said collapsible inner bag, and (f) a removable lid for said transport container.

2. The pack of claim 1 wherein said sealed upper end of said collapsible inner bag is flat.

3. The pack of claim 1 wherein said collapsible inner bag is made of a composite material.

4. The pack of claim 3 wherein said composite material comprises a composite film having at least three layers.

5. The pack of claim 4 wherein at least two of the layers are polymer layers and at least one of the layers is a metal layer interposed between said polymer layers.

6. The pack of claim 5 wherein said metal layer is an aluminum layer.

7. The pack of claim 5 wherein said polymer layers are made of a polymeric material selected from the group consisting of polyolefin, polyethylene, polypropylene, and mixtures thereof.

8. The pack of claim 1 wherein said apertured first disk is made of a flexible composite material.

9. The pack of claim 8 wherein said composite material comprises a composite film having at least three layers.

10. The pack of claim 9 wherein at least two of the layers are polymer layers and at least one of the layers is a metal layer interposed between said polymer layers.

11. The pack of claim 9 wherein said metal layer is an aluminum layer.

12. The pack of claim 9 wherein said polymer layers are made of a polymeric material selected from the group consisting of polyolefin, polyethylene, polypropylene, and mixtures thereof.

* * * * *